US007429708B1

(12) United States Patent
Poyner et al.

(10) Patent No.: US 7,429,708 B1
(45) Date of Patent: Sep. 30, 2008

(54) SAFETY SWITCH

(75) Inventors: Julian Poyner, Stockport (GB); James E. Dogul, Hudson, NH (US); Burt Sacherski, Nashua, NH (US)

(73) Assignee: EJA, Limited, Wigan (GB)

( * ) Notice: Subject to any disclaimer, the term of this patent is extended or adjusted under 35 U.S.C. 154(b) by 0 days.

(21) Appl. No.: 11/767,243

(22) Filed: Jun. 22, 2007

(51) Int. Cl.
*H01H 27/00* (2006.01)

(52) U.S. Cl. ..... 200/43.04; 200/43.07; 200/334

(58) Field of Classification Search ..... 200/43.04, 200/43.07–43.11, 43.16, 61.62, 61.64, 61.66, 200/334
See application file for complete search history.

(56) References Cited

U.S. PATENT DOCUMENTS 5,488,207 A * 1/1996 Niwa et al. ..... 200/43.04
5,584,378 A * 12/1996 Wecke et al. ..... 200/43.04
5,760,353 A * 6/1998 Rapp ..... 200/17 R
5,777,284 A * 7/1998 Mohtasham ..... 200/43.04
5,894,116 A * 4/1999 Da Dalt ..... 200/43.04
5,977,500 A * 11/1999 Mohtasham ..... 200/574
6,310,305 B1 * 10/2001 Kamino et al. ..... 200/43.11
6,329,615 B1 * 12/2001 Biquez ..... 200/43.11
6,469,265 B1 * 10/2002 Penix et al. ..... 200/50.32
6,483,053 B2 * 11/2002 Kajio et al. ..... 200/43.07
6,720,508 B2 * 4/2004 Moriyama et al. ..... 200/200
6,982,391 B2 * 1/2006 Da Dalt ..... 200/43.04

* cited by examiner

*Primary Examiner*—Michael A Friedhofer
(74) *Attorney, Agent, or Firm*—Boyle Frederickson LLP; William R. Walbrun

(57) ABSTRACT

A safety switch that includes a body, a number of contacts, a movable plunger, a signal emitter, and a signal detector. The signal emitter and signal detector are positioned proximate the plunger and configured to assess the operability of the safety switch. The plunger is configured to selectively allow or prevent passage of a signal emitted from the signal emitter toward the signal detector depending on a position of the plunger. Control circuitry in connection with the signal detector is arranged to generate a control signal based on the detection of the emitted signal and configured to control operation of the safety switch independent of the relative position of the number of contacts.

20 Claims, 4 Drawing Sheets

SAFETY SWITCH

BACKGROUND

The present invention relates to safety switches.

Safety switches are often used to control the supply of electricity to electrically powered machinery. Typically, a safety switch is located on a doorpost of an enclosure inside which is located kinetic machinery. On the door to the enclosure is located an actuator which is engageable with the safety switch. When the door to the enclosure is opened, the actuator is not in engagement with the safety switch. As a consequence of this, electrical contacts within the safety switch are kept apart, which means that electricity may not be supplied to the machinery within the enclosure. Thus, a user may enter and move around the enclosure with a reduced risk of injury, since the machinery is not operating. If the door to the enclosure is closed, the actuator is brought into engagement with the safety switch. The contacts in the safety switch are then brought into contact with each other such that electricity may be supplied to the machinery within the enclosure. This sort of arrangement, which is often referred to as a safety interlock, is used in a wide variety of applications. However, depending upon the internal workings of the safety switch, the safety switch may sometimes fail to danger. For example, if the safety switch becomes damaged in one of a number of ways, the contacts within the switch may close. This allows electricity to be supplied to machinery within the enclosure regardless of whether the actuator is engaged or disengaged with the safety switch.

It is therefore an aspect of the present invention to obviate or mitigate a disadvantage of the prior art, whether mentioned herein or elsewhere.

BRIEF DESCRIPTION OF THE INVENTION

According to a first aspect of the present invention there is provided a safety switch that includes a body; a pair of contacts having a fixed position in the body, and a contact plunger provided with a bridge contact. The bridge contact extends across the contact plunger and protrudes from sides of the contact plunger. The contact plunger is moveable to move the bridge contact into and out of electrical connection with the fixed pair of contacts. A biasing element is arranged to bias the contact plunger towards a control mechanism and to bias the bridge contact of the contact plunger toward the fixed pair of contacts. The control mechanism is engageable with an actuator and is moveable to control movement of the contact plunger upon engagement or withdrawal of the actuator. The control mechanism being moveable from a first configuration, where the mechanism resists movement of the contact plunger and keeps the fixed contacts and bridge contacts out of electrical connection with one another, to a second configuration, where the control mechanism allows the contact plunger to move to bring the bridge contact into electrical connection with the fixed pair of contacts, and wherein the safety switch further comprises: a signal emitter and a signal detector positioned in the body; the contact plunger, or a structure between the contact plunger and the control mechanism, being arranged to selectively allow or prevent passage of an emitted signal from the signal emitter to the signal detector depending on the position of the contact plunger, or structure between the contact plunger and the control mechanism, relative to the signal emitter and detector; and control circuitry in connection with the signal detector, and arranged to generate a control signal if no emitted signal is detected by the signal detector.

Preferably, the control circuitry is arranged to prevent the safety switch conducting electricity if no emitted signal is detected by the signal detector, even if the bridge contact is in electrical connection with the fixed contacts.

Preferably, the bridge contact is moveable along a part of the length of the contact plunger.

Preferably, the control mechanism is located in a head of the safety switch. The head maybe detachable from the body. Preferably, relative rotation is possible between the head and the body.

The signal emitter maybe located on one side of the contact plunger, or a structure between the contact plunger and the control mechanism, and the signal detector maybe located on an opposite side of the contact plunger, or a structure between the contact plunger and the control mechanism.

Preferably, the contact plunger, or a structure between the contact plunger and the control mechanism, is provided with a notch, a circumferential groove or an aperture arranged to selectively allow or prevent passage of an emitted signal from the signal emitter to the signal detector depending on the position of the contact plunger, or structure between the contact plunger and the control mechanism, relative to the signal emitter and detector.

Alternatively, the contact plunger, or a structure between the contact plunger and the control mechanism, is provided with a reflective surface arranged to selectively allow or prevent passage of an emitted signal from the signal emitter to the signal detector depending on the position of the contact plunger, or structure between the contact plunger and the control mechanism, relative to the signal emitter and detector.

Preferably, the signal emitter is arranged to emit, and the signal detector arranged to detect, a signal comprising: a pressure wave or an electromagnetic wave. Preferably, the emitted signal is electromagnetic, and in the optical range of the electromagnetic spectrum.

Preferably, the control circuitry comprises a switch. Preferably, switch is arranged to open or close open receipt of the control signal to prevent the safety switch conducting electricity.

The control circuitry may comprise control electronics.

Preferably, the structure between the contact plunger and the control mechanism is an axially moveable rod.

Preferably, the control mechanism is a rotatable cam arrangement.

According to a second aspect of the present invention, there is provided a safety switch, comprising: a body; a fixed pair of contacts fixed in position in the body; a contact plunger provided with a bridge contact extending across the contact plunger and protruding from sides of the contact plunger, the contact plunger being moveable to move the bridge contact into and out of electrical connection with the fixed pair of contacts; a biasing element, arranged to bias the contact plunger towards a control mechanism and to bias the bridge contact of the contact plunger toward the fixed pair of contacts; the control mechanism being engageable with an actuator, and being moveable to control movement of the contact plunger upon engagement or withdrawal of the actuator, the control mechanism being moveable from a first configuration, where the mechanism resists movement of the contact plunger and keeps the fixed contacts and bridge contacts out of electrical connection with one another, to a second configuration, where the control mechanism allows the contact plunger to move to bring the bridge contact into electrical connection with the fixed pair of contacts, and wherein the safety switch further comprises: a signal emitter and a signal detector positioned in the body; the contact plunger, or a structure between the contact plunger and the control mechanism, being arranged to selectively allow or prevent passage of an emitted signal from the signal emitter to the signal detector depending on the position of the contact plunger, or structure between the contact plunger and the control mechanism, relative to the signal emitter and detector; and control circuitry in connection with the signal detector, and arranged to generate a control signal if the emitted signal is detected by the signal detector.

The safety switch according to the second aspect of the present invention may have one or more of the features of the safety switch according to the first aspect of the present invention.

Embodiments of the present invention will now be described, by way of example only, with reference to the accompanying Figures in which like features have been given the same reference numerals, and in which:

DETAILED DESCRIPTION

Figure 1A:
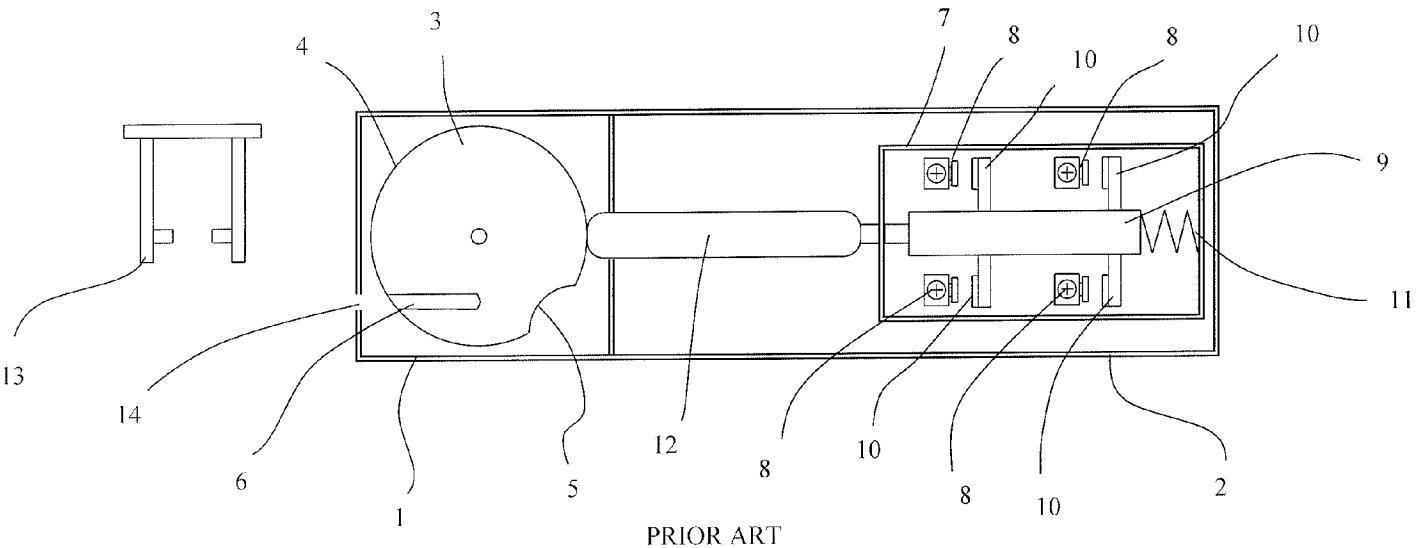
PRIOR ART FIG. 1A
FIGS. 1*a* to 1*d* depict a prior art safety switch.

FIG. 1*a* depicts a prior art safety switch. The safety switch is formed from two parts. The first part is a head 1. The head is connected to the second part of the safety switch, which is a body 2. Relative rotation of the head 1 to the body 2 is possible, to allow for different installation configurations.

The head 1 contains a rotatable cam arrangement 3. An outermost surface 4 of the cam arrangement 3 is provided with a recess 5. The cam arrangement 3 is also provided with a notch 6.

The body 2 of the safety switch contains a contact block 7. The contact block 7 is provided with fixed contacts 8 which are fixed in position relative to the contact block 7 and body 2 of the safety switch. The fixed contacts 8 are in electrical connection with electrically powered machinery, or a controller for that machinery. Extending through the contact block 7 and between the fixed contacts 8 is a contact block plunger 9. The contact block plunger 9 is provided with a pair of bridging contacts 10 which are moveable, against the bias of springs (not shown) along a section of the length of the contact block plunger 9. The contact block plunger 9 is moveable within the contact block 7 to bring the bridging contacts 10 into electrical connection with the fixed contacts 8. Attached to one end of the contact block plunger 9 is a spring 11. The spring 11 biases the contact block plunger 9 and the bridging contacts 10 carried by the contact block plunger 9 towards the head 1 of the switch, such that the bridging contacts 10 are biased towards the fixed contacts 8 of the contact block.

The contact block plunger 9 is in contact with an axially moveable rod 12 via an aperture (not shown) in the contact block 7. The axially moveable rod 12 extends through an aperture (not shown) provided in the body 2 and head 1 of the safety switch. The spring 11 of the contact block 7 biases the contact block plunger 9 against the axially moveable rod 12. The axially moveable rod 12 is in turn biased against the cam surface 4 of the cam arrangement 3 in the head 1 of the safety switch. As can be seen from the Figure, the cam arrangement 3 is oriented such that the position of the axially moveable rod 12 does not allow the contact block plunger 9 to bring the bridging contacts 10 into contact with the fixed contacts 8 (i.e. the cam arrangement 3 is in a first configuration). Thus, in the configuration shown in FIG. 1*a*, the fixed contacts 8 and bridging contacts 10 are not in contact with one another. This means that the safety switch cannot conduct electricity to machinery or a controller in electrical connection with the fixed contacts 8.

The safety switch can be made to conduct electricity by insertion of an actuator 13. The actuator 13 may be passed though an aperture 14 provided in the head 1 of the safety switch, and may be brought into engagement with the notch 6 of the cam arrangement 3.

Figure 1B:
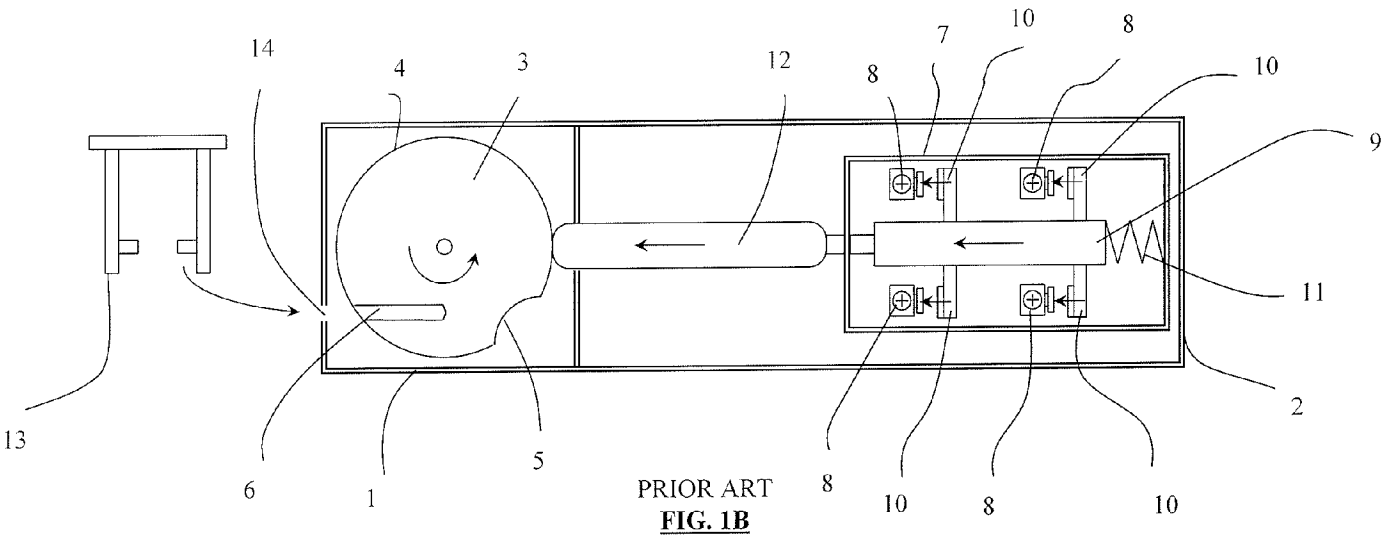
PRIOR ART FIG. 1B

FIG. 1*b* illustrates what happens when the actuator 13 is passed through the aperture 14 of the head 1 of the safety switch, and brought into engagement with the notch 6 of the cam arrangement 3. When the actuator 13 is brought into engagement with the notch 6, the cam arrangement 3 is made to rotate in an anti-clockwise direction (i.e. the cam arrangement 3 rotated to a second configuration). When the cam arrangement 3 rotates in an anti-clockwise direction, the recess 5 is brought into alignment with an end of the axially moveable rod 12. The axially moveable rod 12, which is biased by the spring 11 via the contact block plunger 9, moves into the recess 5. Because the axially moveable rod 12 has been allowed to move, the contact block plunger 9, which is biased towards the head of the head 1 of the safety switch by the spring 11, is allowed to move and to bring the bridge contacts 10 into contact with the fixed contacts 8.

Figure 1C:
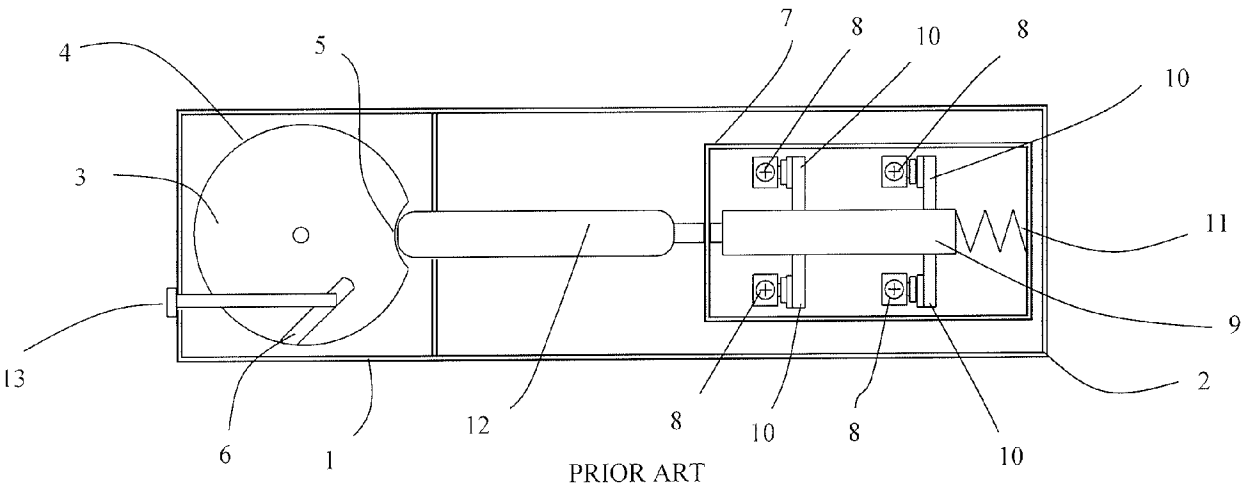
PRIOR ART FIG. 1C

FIG. 1*c* shows the safety switch when the actuator 13 has been brought into engagement with the cam arrangement 3. As mentioned previously, it can be seen that the bridge contacts 10 have been brought into contact with the fixed contacts 8. A current can now flow between the fixed contacts 8 via the bridge contacts 10, meaning that the safety switch is able to conduct electricity to, for example, electrically powered machinery or a controller.

The safety switch shown in FIGS. 1*a*-1*c* is commonly used. It finds a wide variety of applications both in light and heavy industries. Although widely used, this safety switch has inherent disadvantages.

Figure 1D:
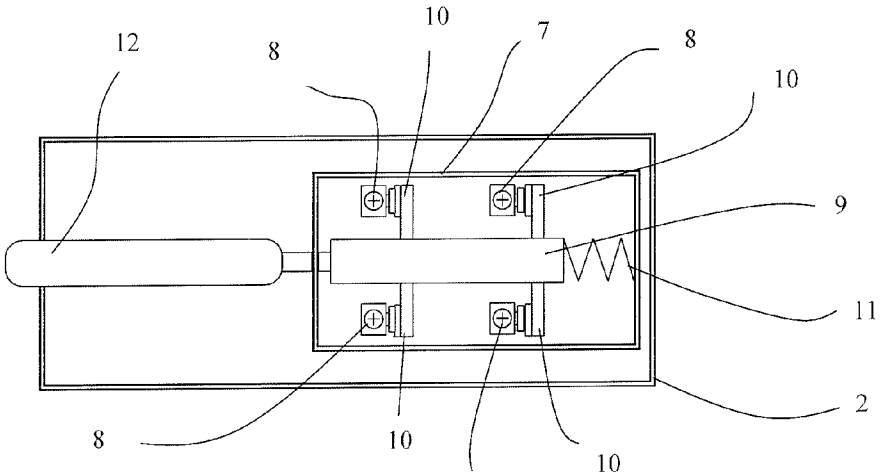
PRIOR ART FIG. 1D

FIG. 1*d* illustrates the situation when the head 1 of the safety switch has become detached from the body 2 on the safety switch. Such detachment may occur, for example, when a vehicle strikes the safety switch, or due to general wear and tear of the safety switch. It can be seen that when the head 1 of the safety switch has become detached from the body, there is no cam arrangement 3 to push against the axially moveable rod 12 and the contact block plunger 9 which the rod 12 is in contact with. Thus, when the head 1 of the safety switch has become detached, there is nothing to stop the spring 11 biasing the contact block plunger 9 to bring the bridge contacts 10 into contact with the fixed contacts 8 of the contact block 7. It can therefore be seen that when the head 1 of the safety switch becomes detached, the safety switch fails to danger in that the default configuration of the safety switch is that it conducts electricity. Clearly this is undesirable, since a user could enter an enclosure to which the safety switch is attached while machinery within the enclosure is powered and operating. The switch may also fail to danger for the same reasons if the cam arrangement 3 becomes detached, or becomes worn.

Figure 2A:
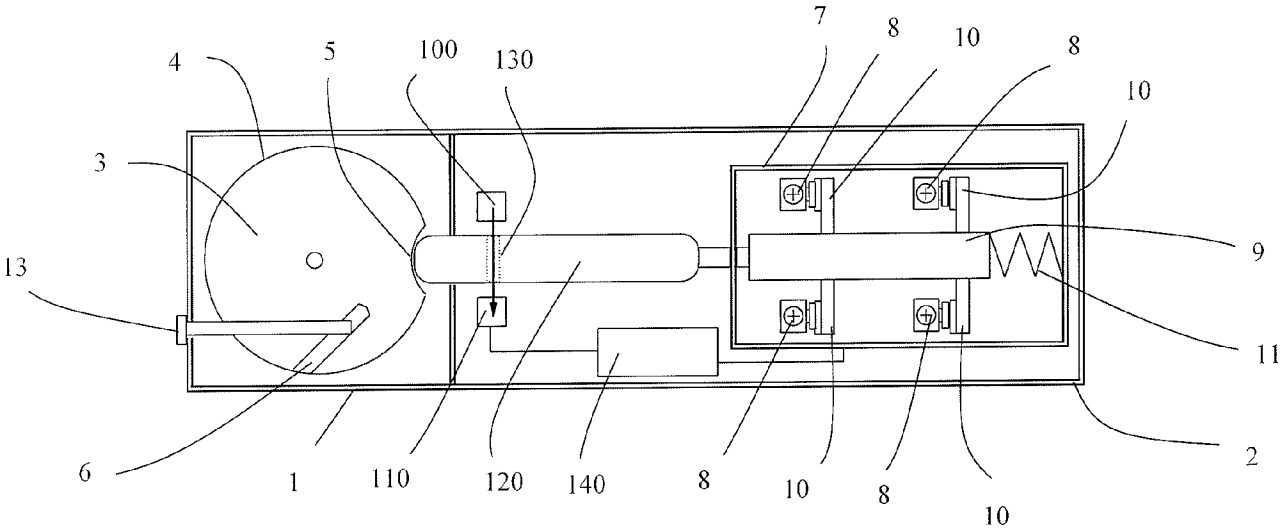
FIGS. 2*a* to 2*f* depict a safety switch according to an embodiment of the present invention, and operating principles of that safety switch.

FIG. 2*a* illustrates a safety switch in accordance with an embodiment of the present invention. The safety switch of FIG. 2*a* is, in general, similar to the safety switch of FIG. 1*a*, and common features have been given common reference numerals accordingly. In contrast to the prior art safety switch of FIG. 1*a*, the safety switch of FIG. 2*a* is provided with a light source 100 and photo detector 110. The light source 100 and photo detector 110 are positioned either side of an axially moveable rod 120. The axially moveable rod 120 is provided with a shaped section 130 which is shaped to either allow or prevent passage of light from the light source 100 to the photo detector 110 upon movement of the axially moveable rod 120.

FIG. 2*a* shows that the actuator 13 has been brought into engagement with the notch 6 of the cam arrangement 3. The recess 5 of the cam arrangement 3 has been brought into alignment with an end of the axially moveable rod 120, such that the axially moveable rod 120 moves into the recess 5 under bias from the spring 11. It can be seen that since the axially moveable rod 120 has moved into the recess 5, the contact block plunger 9 has also moved, and brought the bridge contacts 10 into contact with the fixed contacts 8. It can also be seen that when the axially moveable rod 120 is in this specific position, light from the light source 100 may pass through or past a part of the shaped section 130 of the axially moveable rod 120 and onto the photo detector 110.

The photo detector 110 is connected to control electronics 140. When the photo detector 110 detects light from the light source 100, control electronics 140 permit the safety switch to conduct electricity. That is, if no light is detected by the photo detector 110, the control electronics 140 will prevent the safety switch from conducting electricity, regardless of the configuration of the fixed contacts 8 and bridge contacts 10 (i.e. even if the bridge contacts 10 are in contact with the fixed contacts 8, the control electronics 140 will override them and prevent the safety switch from conducting electricity). This may be achieved by operation of a switch or the like in the control electronics, or in any other suitable manner.

Figure 2C:
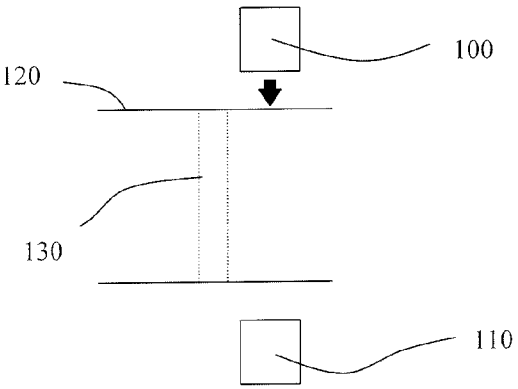
Figure 2B:
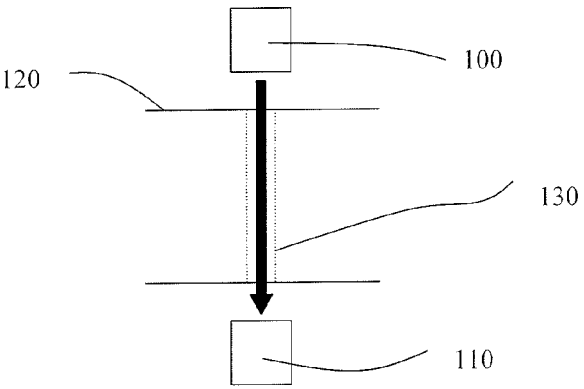

FIG. 2*b* shows the override principle in more detail. It can be seen that when the axially moveable rod 120 is in a first position, the light from the light source 100 may pass through or past the shaped section 130 of the axially moveable rod 120, and onto the photo detector 110. In contrast, if the axially moveable rod 120 is not in this first position, light from the light source 100 cannot pass through or past the axially moveable rod 120, and is thus prevented from irradiating the photo detector 110. These principles can be used to ensure that the safety switch shown in FIG. 2*a* does not fail to danger when the head 1 on the safety switch becomes detached from the body 2.

Figure 2D:
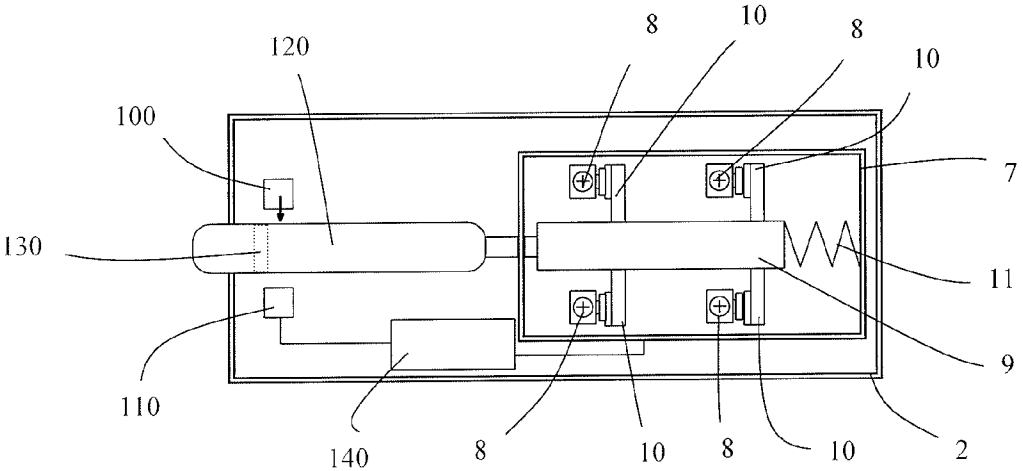

FIG. 2*d* shows the situation when the head 1 of the safety switch has become detached from the body 2 of the safety switch. The head 1 may become detached due to general wear and tear, or, for example, due to an impact from a vehicle or other object. It can be seen that, in a similar manner to that described in relation to FIG. 1*d*, there is no longer a cam arrangement present to resist movement of the axially moveable rod 120. Since there is no cam arrangement, there is nothing to prevent the spring 11 biasing the contact block plunger 9 to the left of the Figure, and thus bringing the bridge contact 10 into contact with the fixed contacts 8. However, in contrast to the safety switch of FIG. 1*d*, the safety switch of FIG. 2*d* is provided with the light source 100, photo detector 110, and control electronics 140. It can be seen that the shaped section 130 is not in alignment with the light source 100 and photo detector 110 because the spring 11 and thus contact block plunger 9 have pushed the axially moveable rod 120 further than they could if the cam arrangement were present. This could be because the bridge contacts 10 have moved when being biased against the fixed contacts, allowing the contact block plunger 9 to push the axially moveable rod 120 further, or because the spring 111 and contact block plunger 9 have suddenly given the axially moveable rod 120 some momentum.

As discussed in relation to FIGS. 2*a*, 2*b* and 2*c*, when the shaped section 130 is moved out of alignment with the light source 100 and photo detector 110, light emitted from the light source 100 cannot pass onto and be detected by the photo detector 110. As a consequence of this, the control electronics 140 do not allow the safety switch to conduct electricity, regardless of the configuration of the fixed contacts 8 and bridge contacts 10 in the contact block 7. The safety switch according to an embodiment of the present invention therefore fails to a safe configuration if the head 1 and body 2 of the safety switch become separated. Similarly, the safety switch according to an embodiment of the present invention fails to a safe configuration if the cam arrangement becomes detached, or becomes worn or damages to such an extent as to allow the axially moveable rod 120 to move to such an extent to move the shaped section 130 out of alignment with the light source 100 and photo detector 110. Furthermore, if the actuator 13 is withdrawn from the safety switch, the moveable rod 120 is moved to a position where the shaped section 130 is moved out of alignment with the light source 100 and photo detector 110. That is, removal of the actuator 13 from the safety switch can also be detected by no light being detected by the photo detector 110.

Figure 2F:
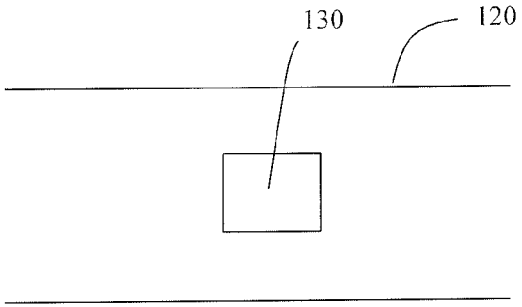
Figure 2E:
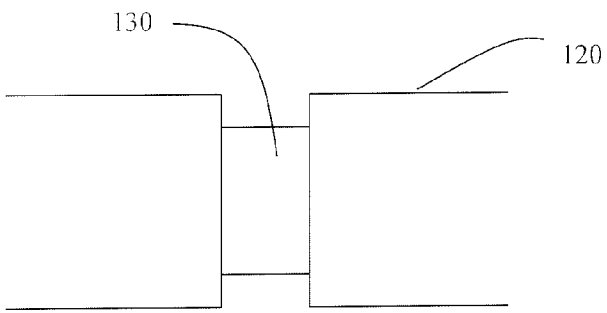

FIG. 2*e* shows that the shaped section 130 of the axially moveable rod 120 may be formed by a circumferential groove extending around the circumference of the axially moveable rod 120. The circumferential groove will effectively provide an indentation which, by movement of the axially moveable rod 120, will selectively allow or prevent light from the light source 100 passing onto the photo detector 110. It will be appreciated that the groove or indentation does not necessarily need to extend all the way around the axially moveable rod 120, and can instead be made to extend about a part of the rod 120. FIG. 2*f* shows an alternative arrangement, where the shaped section 130 is an aperture extending through the axially moveable rod 120. When the axially moveable shaped section 130 is moved, the light from the light source 100 is selectively allowed or prevented from passing through the rod 120 via the aperture.

It will be appreciated that shapes and configurations other than a circumferential or other groove, or an aperture through the rod, are envisioned. In some embodiments, all that is required is that the axially moveable rod is shaped such that it selectively allows or prevents passage of light from a light source to a photo detector depending on its position relative to the light source and the photo detector. Instead of the axially moveable rod being so shaped, any structure between the cam arrangement and contact plunger could be appropriately shaped. That is, it is envisioned that the movable member could be any of a number of shapes other than the rod shape shown in the present drawings. For example, any linking structure may be used which transfers movement of the cam arrangement into movement of the contact block plunger. In some switches, there may be no need for an axially moveable rod. Therefore, the contact block plunger may be appropriately shaped to selectively allow or prevent passage of light from a light source to a photo detector depending on its position relative to the light source and the photo detector.

In some embodiments, the moveable rod (or intermediate linking structure) may not be shaped to, when moved, selectively allow or prevent passage of light from a light source to a detector. Instead, the moveable rod (or intermediate linking structure) may be provided with a reflective surface. The reflective surface may be a reflective section located on the moveable rod (or intermediate linking structure), or extending around the moveable rod (e.g. in the shape of a band or the like). The moveable rod (or intermediate linking structure) is then moveable to move the reflective surface into and out of alignment with the light source. When in alignment, the reflective surface reflects light from the light source to the detector. The detector may be located adjacent to or be a part of the light source, or may be located at any position where light may be reflected to. A safety switch having a moveable rod (or intermediate linking structure) with a reflective surface would otherwise work the same as a safety switch having a moveable rod (or intermediate linking structure) provided with an aperture or notch, as described above and below. In general, therefore, the moveable rod (or intermediate linking structure) is provided with a section which is arranged to selectively allow or prevent passage of light from the light source to the photo detector, whether the section allows transmission of the light, reflection of the light or otherwise.

In the embodiment of FIGS. 2*a* to 2*f*, a light source 100, and a photo detector 110 have been described. It is appreciated that the safety of the present invention is operable with other transmission and detection modalities. That is, instead of light detection, an acoustic wave can be passed from an acoustic source to an acoustic detector, its passage being selectively allowed or prevented by the relative position of the axially moveable rod 120. It will be appreciated that any means may be employed. For example electromagnetic or pressure waves may be used, with appropriate signal emitters and signal detectors used to emit and detect these waves. An optical (e.g. light) signal emitter and photo detector may be preferable due to their low cost and high reliability. Visible light may be preferable, so that the operating state of the signal emitter is readily visible to a user.

The switch described in relation to FIGS. 2*a* to 2*f* has been described as fail safe, in so far as that if the head 1 of the safety switch becomes detached from the body 2, the safety switch will fail to a non-conducting configuration. It has been stated that the safety switch will only be allowed to conduct electricity when the bridge contacts 10 are in contact with the fixed contacts 8, and also when light is detected by the photo detector 110. That is, if the shaped section 130 of the axially moveable rod 120 becomes blocked with, for example, dirt, and prevents passage of light to the photo detector, the switch will again fail safe, since the control electronics 140 will not allow the switch to move into a connecting state. The shaped section 130 can be cleaned, and the safety switch put back into an operational state.

The control electronics 140 mentioned above may be included in the safety switch solely for the purpose of determining whether light has been detected by the photo detector 110 and then controlling the conducting state of the safety switch. Alternatively, the control electronics 140 may have other functions, such as for example controlling the energising of a solenoid (not shown) often used in safety switches. The control electronics 140 may form part of one or more safety relays used in or in conjunction with the safety switch, or form part of a printed circuit board used in or in conjunction with the safety switch. A separate control electronic can be eliminated so long as there is some sort of control circuitry which can prevent the safety switch from conducting electricity if no light is detected by the photo detector. For example, circuitry not comprising electronic components, as is known in the art, may be employed.

The control electronics 140 may prevent the safety switch from conducting electricity in any appropriate manner. For example, if no light is detected by the photo detector 110, the control electronics can open or close an override switch which is in series with machinery connected to the fixed contacts. This override switch may be closed only when light is detected by the photo detector 110. The switch may be mechanical, or solid-state.

In the embodiments described above, the control electronics have been described as preventing the safety switch from conducting electricity when no light is detected by the detector. This may be achieved by the control (i.e. the sending of a signal to) a switch or the like. However, the safety switch may also be configured to control operation machine without otherwise preventing electricity from being conducted. Instead of providing an automatic shut-off function, the control electronics can invoke a reduced risk state of operation, or diagnostics of some sort. For example, if no light is detected by the detector, the control electronics could send a signal to the machinery to which the safety switch is connected to slow down the speed of operation of the machine, or to put the machinery into an idle or neutral state (while still being powered). Alternatively, the control electronics may not have any impact at all on the immediate operation of the safety switch, the signal which the control electronics generates may be used to alert the users that a fault has occurred (e.g. to illuminate a light source or audible device) without otherwise limiting the operation of the machinery.

In the embodiments described above, the control electronics have been described as preventing the safety switch from conducting electricity when no light is detected by the detector. The control electronics perform this function by generating a control signal which could be sent to open or close a switch or the like. There may also be operating configurations where it is unnecessary for the control electronics to generate a signal when light is detected by the photo detector. In some embodiments it may be preferable to employ or configure control electronics to generate a control signal when light is detected by the detector. This means that a control signal would only be generated when the moveable rod has been brought into alignment with the light source and photo detector. At all other times, no signal is generated. So, for example, the generation of a control signal in this configuration could be used to open or close a switch (or the like) to prevent the safety switch from conducting electricity. A safety switch having control electronics that generate a signal when light is detected by the detector may have any of the features of the safety switch having control electronics that generate a signal when light is not detected by the detector.

The above safety switch has been described as having a cam arrangement 3. However, it will be appreciated that the invention is equally applicable to safety switches not having a cam arrangement, for example those switches having another control mechanism for controlling the position of the axially moveable rod 120 and contact block plunger 9. For example, a linear control mechanism could be used to push against the axially moveable rod 120, or conversely, to allow the axially moveable rod 120 to move into a recess or the like provided in the linear control mechanism.

It will be appreciated that the above embodiments have been given by way of example only. It will be further appreciated that various modifications may be made to these and indeed other embodiments without departing from the scope of the invention as defined by the claims that follow.

What we claim is:

1. A safety switch, comprising:

a body;

a fixed pair of contacts fixed in position in the body;

a contact plunger provided with a bridge contact extending across the contact plunger and protruding from sides of the contact plunger, the contact plunger being moveable to move the bridge contact into and out of electrical connection with the fixed pair of contacts;

a biasing element, arranged to bias the contact plunger towards a control mechanism and to bias the bridge contact of the contact plunger toward the fixed pair of contacts;

the control mechanism being engageable with an actuator, and being moveable to control movement of the contact plunger upon engagement or withdrawal of the actuator, the control mechanism being moveable from a first configuration, where the control mechanism resists movement of the contact plunger and keeps the fixed contacts and the bridge contact out of electrical connection with one another, to a second configuration, where the control mechanism allows the contact plunger to move to bring the bridge contact into electrical connection with the fixed pair of contacts, and wherein the safety switch further comprises:

a signal emitter and a signal detector positioned in the body;

a structure between the contact plunger and the control mechanism arranged to selectively allow or prevent passage of an emitted signal from the signal emitter to the signal detector depending on a position of the structure relative to the signal emitter and detector; and control circuitry in connection with the signal detector, and arranged to generate a control signal if the emitted signal is not detected by the signal detector.

2. The safety switch as claimed in claim 1, wherein the control circuitry is arranged to prevent the safety switch from conducting electricity if no emitted signal is detected by the signal detector, even if the bridge contact is in electrical connection with the fixed contacts.

3. The safety switch as claimed in claim 1, wherein the bridge contact is moveable along a part of a length of the contact plunger.

4. The safety switch as claimed in claim 1, wherein the control mechanism is located in a head of the safety switch.

5. The safety switch as claimed in claim 4, wherein the head is detachable from the body.

6. The safety switch as claimed in claim 4, wherein relative rotation is possible between the head and the body.

7. The safety switch as claimed in claim 1, wherein the signal emitter is located on one side of the structure and the signal detector is located on an opposite side of the structure.

8. The safety switch as claimed in claim 1, wherein the structure is provided with one of a notch, a circumferential groove, an aperture, or a reflective surface arranged to selectively allow or prevent passage of an emitted signal from the signal emitter to the signal detector depending on the position of the structure relative to the signal emitter and detector.

9. The safety switch as claimed in claim 1, wherein the structure is further defined as one of the contact plunger or an axially movable rod.

10. The safety switch as claimed in claim 1, wherein the signal emitter is arranged to emit, and the signal detector arranged to detect, a signal comprising at least one of: an optical signal, a laser signal, an acoustic signal, a pressure wave or an electromagnetic wave.

11. The safety switch as claimed in claim 10, wherein the emitted signal is electromagnetic, and in the optical range of the electromagnetic spectrum.

12. The safety switch as claimed in claim 1, wherein the control circuitry comprises a switch.

13. The safety switch as claimed in claim 12, wherein the switch is arranged to open or close upon receipt of the control signal to prevent the safety switch from conducting electricity.

14. The safety switch as claimed in claim 1, wherein the control circuitry comprises control electronics.

15. The safety switch as claimed in claim 1, wherein the control mechanism is a rotatable cam arrangement.

16. A safety switch, comprising:

a body;

a pair of contacts having a fixed position in the body;

a contact plunger provided with a bridge contact extending across the contact plunger and protruding from sides of the contact plunger, the contact plunger being moveable to move the bridge contact into and out of electrical connection with the fixed pair of contacts;

a biasing element, arranged to bias the contact plunger towards a control mechanism and to bias the bridge contact of the contact plunger toward the fixed pair of contacts;

the control mechanism being engageable with an actuator, and being moveable to control movement of the contact plunger upon engagement or withdrawal of the actuator, the control mechanism being moveable from a first configuration, where the control mechanism resists movement of the contact plunger and keeps the fixed contacts and the bridge contact out of electrical connection with one another, to a second configuration, where the control mechanism allows the contact plunger to move to bring the bridge contact into electrical connection with the fixed pair of contacts, and wherein the safety switch further comprises:

a signal emitter and a signal detector positioned in the body;

the contact plunger being arranged to selectively allow or prevent passage of an emitted signal from the signal emitter to the signal detector depending on a position of the contact plunger relative to the signal emitter and detector; and control circuitry in connection with the signal detector, and arranged to generate a control signal if the emitted signal is detected by the signal detector.

17. A safety switch comprising:

a housing;

a set of fixed contacts supported by the housing;

a set of movable contacts positioned proximate the set of fixed contacts;

a plunger constructed to support the set of movable contacts and movable between a first position wherein the fixed and movable contacts are engaged and a second position wherein the fixed and movable contacts are separated;

a biasing element constructed to bias the plunger to the first position;

a signal emitter positioned proximate the plunger;

a detector positioned proximate the signal emitter; the signal emitter and the detector configured to determine a position of the plunger; and a controller configured to control communication of power through the contacts based on a signal from the detector independent of a position of the movable contacts relative to the fixed contacts.

18. The safety switch of claim 17 wherein the plunger further comprises a contour configured to interfere with communication between the signal emitter and the detector based on a position of the plunger relative to the housing.

19. The safety switch of claim 18 wherein the contour is at least one of a groove, a recess, a passage, or a reflective area.

20. The safety switch of claim 17 wherein the plunger is movable to a third position outside an area between the first position and the second position when a head portion is removed from the housing.

* * * * *